US005119551A

United States Patent [19]

Abbott

[11] Patent Number: 5,119,551

[45] Date of Patent: Jun. 9, 1992

[54] METHOD OF MAKING A CATALYTIC CONVERTER WITH ONE PIECE HOUSING

[75] Inventor: James R. Abbott, Jackson, Mich.

[73] Assignee: Tennessee Gas Pipeline Company, Lincolnshire, Ill.

[21] Appl. No.: 724,387

[22] Filed: Jun. 28, 1991

Related U.S. Application Data

[62] Division of Ser. No. 306,915, Feb. 6, 1989.

[51] Int. Cl.[5] ..... B21D 53/00

[52] U.S. Cl. ..... 29/890; 29/457; 29/890.08; 55/DIG. 30; 422/180; 422/190

[58] Field of Search ..... 29/890, 890.08, 422, 29/457, 515; 422/171, 172, 179, 180, 190, 221, 222; 60/299, 301; 181/282; 55/DIG. 30

[56] References Cited

U.S. PATENT DOCUMENTS

| | | | |
|---|---|---|---|
| 2,005,306 | 6/1935 | Wallis | 72/367 |
| 3,220,507 | 11/1965 | Jettinghoff | 181/53 |
| 3,289,785 | 12/1966 | Walker | 181/48 |
| 3,315,761 | 4/1967 | Selig | 181/48 |
| 3,648,803 | 3/1972 | Heath et al. | 181/48 |
| 3,978,567 | 9/1976 | Vroman | 29/890 |
| 4,020,539 | 5/1977 | Vroman | 29/890 |
| 4,207,661 | 6/1980 | Mase et al. | 29/890 |
| 4,239,733 | 12/1980 | Foster et al. | 422/179 |
| 4,269,807 | 5/1981 | Bailey et al. | 422/179 |
| 4,335,078 | 6/1982 | Ushijima et al. | 422/179 |
| 4,343,074 | 8/1982 | Bailey et al. | 29/890 |
| 4,413,392 | 11/1983 | Otani et al. | 29/890 |
| 4,559,205 | 12/1985 | Hood | 422/180 |
| 4,667,386 | 5/1987 | Enomoto et al. | 29/890 |

*Primary Examiner*—Irene Cuda
*Attorney, Agent, or Firm*—Harness, Dickey & Pierce

[57] ABSTRACT

A catalytic converter with a one piece housing is made by inserting catalyst elements into opposite open ends of a sheet metal tube until their support mats abut against preformed annular ribs after which annular ribs are formed in the tube to engage the other ends of the support mats and the ends of the tube are pinched together to form sealed end closures with gas flow passages in them.

6 Claims, 2 Drawing Sheets

METHOD OF MAKING A CATALYTIC CONVERTER WITH ONE PIECE HOUSING

This is a division of U.S. patent application Ser. No. 07/306,915, filed Feb. 6, 1989 entitled "Catalytic Converter with One Piece Housing".

Catalytic Converter with One Piece Housing

This invention relates to catalytic converters useful in motor vehicle exhaust gas systems and, in particular, to converters of the type having one or more ceramic monoliths or substrates mounted inside of a sheet metal housing, the substrates containing a multiplicity of longitudinal straight-through-flow exhaust gas passages that are coated with catalyst.

Typically, the metal housings for commercially acceptable converters of the type just described are of the so-called "pancake" or "clamshell" design; i.e., they comprise stamped upper and lower shells, which are substantially identical to each other, and which have mating, peripheral, side flanges that are welded together to lie in a plane containing the longitudinal axis of the housing. They are shaped to form an internal chamber in which the substrates are mounted. Another commercial form of catalytic converter housing comprises a tube with separate end cones welded at each end; i.e., a three-piece housing.

It is the purpose of the present invention to provide a converter of the type described above, and the method of making it, which has a one-piece, metal, tubular housing instead of a two-piece "clamshell" housing or the three-piece end cone type housing. A converter according to the invention performs at least as well as one having a prior type housing but has a construction that is inherently more economical to produce and one that can be mass-manufactured in the large volumes required to supply original equipment converters directly to manufacturers of automobiles and trucks for factory installation in exhaust systems.

The present invention involves the use of an open-ended metal tube that has a first annular indentation formed in it to serve as a locating and holding rib. The catalyst coated ceramic substrate with a circumferential support mat is placed inside of the tube so that the innermost end edge of the support mat abuts the first annular rib. Thereafter, a second annular indentation is formed in the metal tube at a location in which it abuts the other or outermost end edge of the support mat so that it also serves as a locating and holding rib for the substrate. After the substrate is positioned in the tube, the open ends of the tube are pinched together by radial deformation to close the ends of the tube and form an inlet aperture in one end and an outlet aperture in the other end. In a preferred embodiment, the above procedure is used to position two substrates in the housing, one being coated with three way catalysts to convert nitrous oxides, carbon monoxide, and hydrocarbons and the other being coated with oxidation cataylsts to covert carbon monoxide and hydrocarbons.

Other features and advantages of the invention will appear in the detailed description.

DETAILED DESCRIPTION OF A PREFERRED EMBODIMENT

Figure 1:
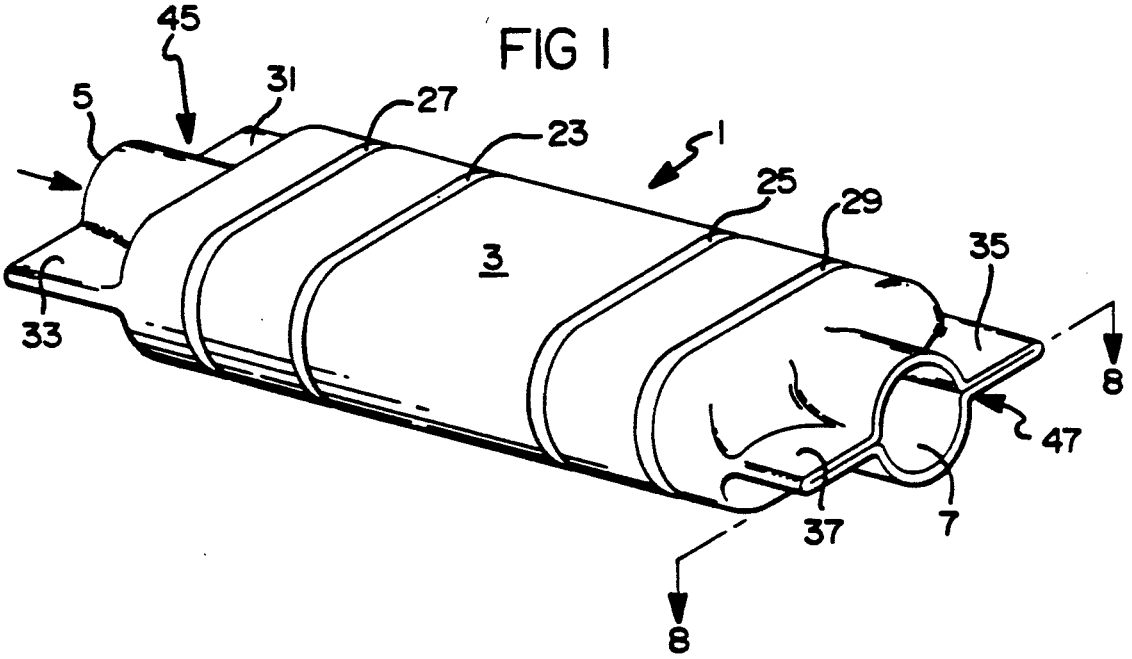
FIG. 1 is a perspective view of a catalytic converter according to the invention.
Figure 2:
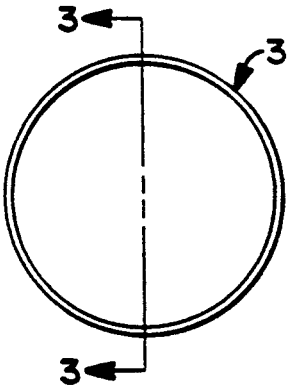
FIG. 2 is an end view of a round tube from which the housing of FIG. 1 may be fabricated.

In accordance with the invention, a catalytic converter 1 has a one piece, tubular metal housing 3 with an inlet 5 at one end and an outlet 7 at the other end. A first substrate 9 with circumferentially surrounding and narrower band-like support mat 11 is positioned inside of the housing 3 adjacent the inlet 5 end of the housing. A second substrate 13 with its circumferentially surrounding and narrower band-like support mat 15 is positioned inside of the housing 3 adjacent the outlet 7 end of the housing and is longitudinally separated from substrate 9. The substrates 9 and 13 are of the same but smaller cross section as the housing 3 and their outer peripheral surfaces are uniformly spaced radially inwardly from the inner wall of the housing. The ends of the support mats are located inwardly of the end faces of the substrates as shown in the drawings. The support mats are composed of a gas impervious, vermiculite based material, available on the open market, which is intumescent and expands substantially upon heating.

The substrates 9 and 13 subdivide the space inside of the housing 3 into three chambers; i.e., and inlet chamber 17 between the inlet 5 and the inlet side of the substrate 9, a central chamber 19 between the outlet side of substrate 9 and the inlet side of substrate 13, and an outlet chamber 21 between the outlet side of substrate 13 and the outlet 7. Though not illustrated, it is to be understood that each substrate has a great number of longitudinally extending straight-through flow gas passages and that these are coated with appropriate catalysts. Thus, gas can flow straight through the converter 1 from inlet passage 5 to outlet passage 7, being treated as it flows through the longitudinal passages in the catalysts elements defined by substrates 9 and 13. The substrates 9 may contain three-way cataylsts to convert nitrous oxides, carbon monoxide, and hydrocarbons to nitrogen, water, and carbon dioxide. The substrate 13 may contain an oxidation catalyst and secondary air may be supplied to chamber 19 to convert carbon monoxide and hydrocarbons to water and carbon dioxide. A secondary air inlet and conduit 19A is illustrated diagrammatically in FIG. 8.

In further accord with the invention, a substrate locating and holding means is provided in the form of a first and inner set of annular, rib-forming indentations 23 and 25 in the wall of the tubular housing 3 located adjacent opposite ends of central chamber 19. A second and outer set of similar annular rib-forming indentations 27 and 29 is also formed in housing 3 to cooperate, respectively, with ribs 23 and 25 in locating and holding the substrates 11 and 13, respectively, in place in the housing.

Preferably, the depth of the indentations is about half the thickness of the mats 11 and 15. This enables them to protect the ends of the non-metallic support mats to some degree from gas flowing in the converter and still allows some relative movement of the substrate with respect to the housing (due to resiliency in the mats) without contact with the substrate. The indentation 27 is spaced from the indentation 23 by a longitudinal distance that is about the same as or slightly less than than the width of the mat 11 at the time of its insertion into the housing 3. The indentation 29 is longitudinally spaced from the indentation 25 by a distance that is about the same as or slightly less than the width of the mat 15 at the time of its insertion into the housing 3.

Figure 8:
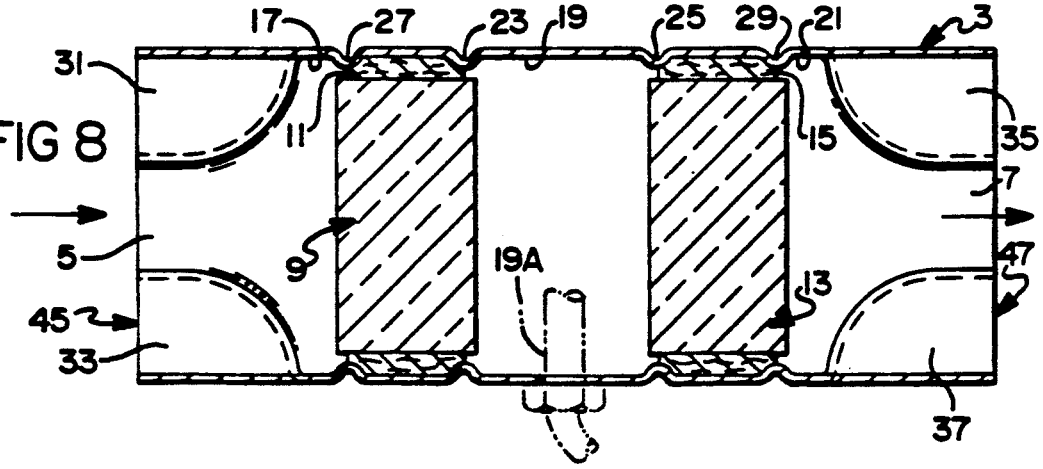
FIG. 8 is a view similar to FIG. 7 (and coresponds to a section along plane 8—8 of FIG. 1) and shows the second set of ribs along with the pinched down ends of the tube from which the converter housing is formed.

As seen in FIGS. 1 and 8, at each end of the housing opposite sides are in engagement to close the ends of the housing. At the inlet end, the top and bottom of the tubular housing 3 are radially deformed or squeezed together to produce the inlet passage 5 and the pinched-together corners 31 and 33 on opposite sides of the passage 5. The pinched corners 31 and 35 comprise a double thickness of metal and the two layers are preferably welded together to form and serve as closure means that seals the inlet end of the housing except for the formed passage 5. Similarly, at the outlet end the top and bottom of the tubular housing 3 are radially deformed to produce the outlet passage 7 and the pinched-together corners 35 and 37 on opposite sides of the passage 7. The two metal layers of the corners 35 and 37 are preferably welded together whereby they serve as closure means to seal the outlet end, of the housing except for the passage 7. Pinched-in end closures of this general type in exhaust gas mufflers are shown and described in U.S. Pat. No. 3,648,803 of Mar. 14, 1972 of Robert A. Heath and Ronald J. Martoia owned by the assignee of the present invention.

Figure 4:
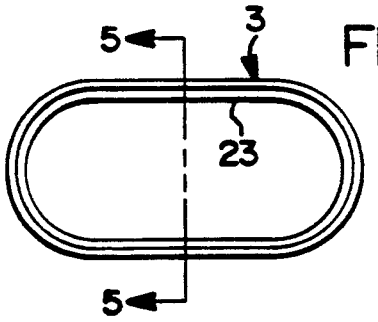
FIG. 4 is an end view of the tube of FIG. 1 after it has been shaped into an oval with ribs.
Figure 3:
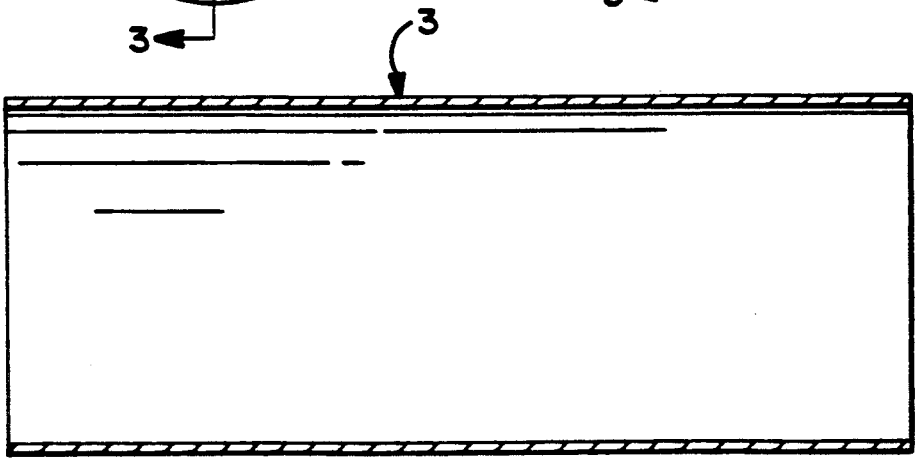
FIG. 3 is an enlarged section along the line 3—3 of FIG. 2 showing that the tube is uniform diameter and thickness and has smooth walls.
Figure 5:
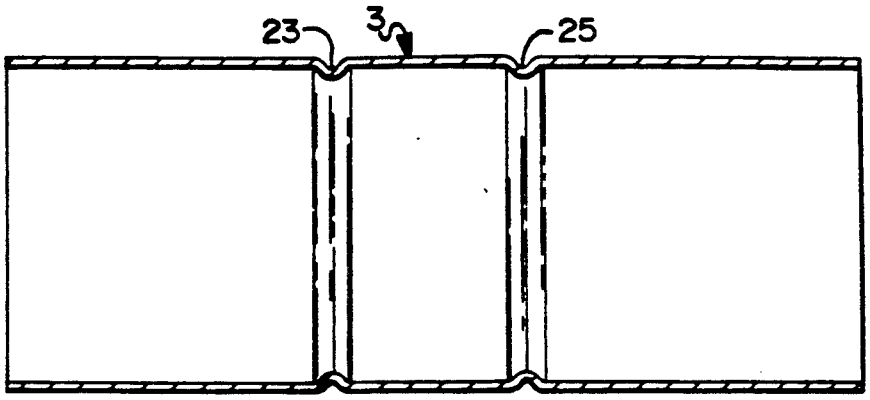
FIG. 5 is an enlarged section along the line 5—5 of FIG. 4.
Figure 6:
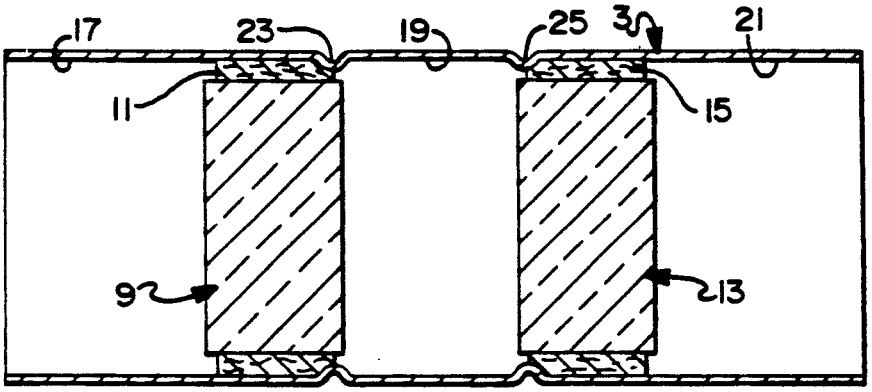
FIG. 6 is a view similar to FIG. 5 but shows two catalyst coated substrates wrapped with support mats inserted into the tube to seat against the ribs.

In general, a converter embodying the invention may be of round cross section such as shown in FIG. 1 or of other cross sections, such as oval. The oval cross section illustrated herein is ordinarily preferred for automotive exhaust systems because the converter can be shaped to occupy minimum vertical space beneath the vehicle. In making the converter 1 of this invention it is convenient to start with commercially available round metal tubing and radially compress it from opposite sides to form the oval shape of FIG. 4. Preferably, this is done by means of dies which simultaneously form the annular indentations 23 and 25 to produce the shape shown in FIG. 5. The substrates 9 and 13 with their peripheral support mats 11 and 15 are of the same outer oval size as the inside of the ovalized housing 3 and they are stuffed into the opposite open ends of the housing until the inner end of mat 11 is pressed against indentation 23 and the inner end of mat 15 is pressed against indentation 25 as shown in FIG. 6.

Figure 7:
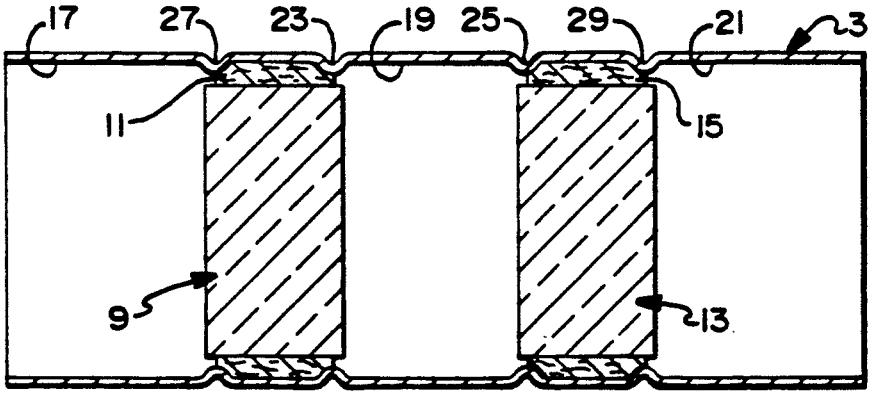
FIG. 7 is a view similar to FIG. 6 but shows the second set of ribs holding the substrates in place.

The next steps are to form the annular indentations 27 and 29 and the inlet end closure 45 (comprising corners 31 and 33 and inlet passage 5) and the outlet end closure 47 (comprising corners 35 and 37 and outlet passage 7). While the indentations 27 and 29 can be rolled into the housing 3 before the end closures are formed, as shown in FIG. 7, it is possible to simultaneously press-form the indentations 27 and/or 29 and the end closures. This eliminates one operation and also helps to protect the adjacent ends of the frangible substrates 9 and 13 from damage during crimping of the end closures. It appears that the ribs on the punch (not shown) for simultaneously pressing the indentations 23 and/or 25 and the end closures (or other parts of such punch) furnish radial support to the ends of the housing adjacent the substrate during pinch down of the housing ends and take some of the load to help avoid crushing of the adjacent corners of the substrate.

The indentations 27 and 29 can be rolled in together or separately. Alternatively, the indentations 27 and 29 together with respective end closures 45 and 47 can be formed one end at a time or both simultaneously. Since the converter is symmetrical, the same tooling can be used to form one end at a time; it being necessary only to simply reverse the housing end for end to perform the desired operation.

The engagement of each combined substrate and mat with the housing is such as to permit them to be longitudinally stuffed into the housing 3. When used in an exhaust system the mats 11 and 15 are heated and expand to such a degree that they tightly hold the substrates in place without the need for mechanical assistance, ribs, or partitions. Ordinarily, the peripheral outer surface of the substrates that engages the mat is rough so that the mat does not tend to slip longitudinally along the substrate even before heat expansion radially compresses it against the outer substrate surface. However, the inner wall of housing 3 is smooth and there is a possibility of slippage between the outer surface of the mat and the housing until heat is applied to and the mat expands. The pre-heat condition exists during the period between manufacture and actual use on a vehicle. During this period much handling of the converter occurs. Slippage at the interface between the mat and housing is avoided, however, by the holding means provided by rib sets 23, 27 and 25, 29. During actual use of the converter, these indentations or ribs reduce the end areas of the mats that are exposed to flowing gas and therefore tend to protect the mats from erosion. At the same time they are located radially outwardly of the substrates so that the full cross sectional areas of the substrates are available for gas flow and treatment. Ribs have been used heretofore in converters with "clamshell" housings in conjunction with metal mesh type substrate supports to help hold the supports in place during actual use of the converter. In this invention, radial compression in the support mats as a result of heat expansion holds them in place during actual use of the converter.

The converter illustrated contains two separate catalyst elements. One of the elements could be omitted along with the appropriate pair of locating and holding ribs so that the converter would contain just one catalyst member but still embody the one piece housing and rib construction described herein.

While the converter is shown as symmetrical about a longitudinal axis through the center lines of passages 5 and 7, it will be recognized that the structure and method described would also enable one or both passages to be transversely offset from the longitudinal axis. If desired, a known type of heat shield may be attached to the converter housing 3 by welding or otherwise.

Modifications may be made in the specific features shown and described without departing from the spirit and scope of the invention.

What is claimed is:

1. The method of making a catalytic converter which comprises forming a first transverse rib in the wall of an open ended sheet metal tube, inserting a monolith type catalyst member into the open end of the tube and moving it longitudinally relative to the tube until its inner end abuts the first transverse rib, thereafter forming a second transverse rib in the wall of the tube so that it is substantially in engagement with the outer end of the catalyst member to hold the catalyst member in longitudinal position wherein it abuts the first transverse rib, and closing the open end of the tube except for a gas flow passage by pressing opposite sides of the end of the tube together to form a double metal layer end closure containing a gas flow passage.

2. A method of making a catalytic converter as set forth in claim 1 comprising rolling said second transverse rib into the wall of the tube so that it is substantially annular.

3. A method of making a catalytic converter as set forth in claim 1 comprising pressing said opposite sides of the end of the tube to form said end closure and simultaneously pressing opposite sides of the tube to form said second transverse rib.

4. The method of making a catalytic converter containing a monolith type catalyst element having a support mat wrapped around its outer periphery which comprises forming a first annular rib in the wall of an elongated open-ended sheet metal tube, inserting the combined catalyst element and support mat into the open end of said tube and moving it longitudinally until the inner end of the support mat engages the first annular rib, thereafter forming a second annular rib in the wall of the tube so that it is substantially in engagement with the outer end of the support mat, and closing the open end of the tube except for a gas flow passage.

5. The method of making a catalytic converter containing a monolith type catalyst element having a support mat wrapped around its outer periphery which comprises pressing a round open-ended sheet metal tube into an oval shape and at the same time pressing a first annular oval rib in the wall of the tube, inserting the combined catalyst element and support mat into the open end of said tube and moving it longitudinally until the inner end of the support mat engages the first annular rib, thereafter forming a second annular rib in the wall of the tube so that it is substantially in engagement with the outer end of the support mat, and closing the open end of the tube except for a gas flow passage by pressing opposite sides of the end of the tube together to form a double metal layer end closure containing a gas flow passage.

6. The method of making a catalytic converter containing two monolith type catalyst elements each having a support mat wrapped around its outer periphery which comprises forming a pair of first annular ribs in a central position of an elongated sheet metal tube that is open at opposite ends, inserting one of the combined catalyst elements and support mats into one open end of said tube and moving it longitudinally until the inner end of its support mat engages one of said first annular ribs, inserting the other of the combined catalyst elements and support mats into the other open end of said tube and moving it longitudinally until the inner end of its support mat engages the other of said first annular ribs, thereafter forming a pair of second annular ribs in said tube with one of said second ribs being located to be substantially in engagement with the outer end of said one of said combined catalyst elements and support mats and the other of said second ribs being located to be substantially in engagement with the outer end of said other of said combined catalyst elements and support mats, and pressing opposite sides of the ends of the tube together to form an end closure at one end containing an inlet gas flow passage and an end closure at the other end containing an outlet gas flow passage.

* * * * *